US005733146A

United States Patent [19]

Block

[11] Patent Number: 5,733,146

[45] Date of Patent: Mar. 31, 1998

[54] SHIELD FOR MODULAR ELECTRICAL CONNECTOR

[76] Inventor: Dale A. Block, 2325 Grand Ave., Schererville, Ind. 46375

[21] Appl. No.: 627,241

[22] Filed: Apr. 1, 1996

[51] Int. Cl.[6] ..... H01R 9/03

[52] U.S. Cl. ..... 439/610; 439/553; 439/607

[58] Field of Search ..... 439/607, 610, 439/350, 352, 357, 358, 553

[56] References Cited

U.S. PATENT DOCUMENTS

| | | | |
|---|---|---|---|
| 4,337,989 | 7/1982 | Asick et al. | 439/609 |
| 4,457,576 | 7/1984 | Cosmos et al. | 439/610 |
| 4,557,545 | 12/1985 | Ohtsuki et al. | 439/610 |
| 4,653,825 | 3/1987 | Olsson | 439/610 |
| 4,732,568 | 3/1988 | Hall | 439/676 |
| 4,738,637 | 4/1988 | Asick et al. | 439/609 |
| 5,055,062 | 10/1991 | Sato | 439/676 |
| 5,083,945 | 1/1992 | Miskin et al. | 439/607 |
| 5,137,472 | 8/1992 | Hillbich et al. | 439/607 |
| 5,145,409 | 9/1992 | Sato et al. | 439/585 |
| 5,199,891 | 4/1993 | Reed | 439/98 |
| 5,228,872 | 7/1993 | Liu | 439/607 |
| 5,236,375 | 8/1993 | Kachlic | 439/607 |
| 5,267,868 | 12/1993 | Wolff, Jr. | 439/95 |
| 5,378,172 | 1/1995 | Roberts | 439/607 |
| 5,397,246 | 3/1995 | Defibaugh et al. | 439/607 |
| 5,425,657 | 6/1995 | Davis et al. | 439/610 |

FOREIGN PATENT DOCUMENTS

| | | | |
|---|---|---|---|
| 9410723 | 5/1994 | WIPO | 439/610 |

*Primary Examiner*—Hien Vu

*Attorney, Agent, or Firm*—Mark D. Hilliard; Robert A. McCann; Michael J. Turgeon

[57] ABSTRACT

A shield assembly for use with a modular electrical connector is provided by a shield housing forming front, bottom and opposing side walls with an open rear end and having a grounding clip disposed on the distal end of a hingedly connected top wall of the shield assembly for engaging the foil shield sheath of the cable and securing the shield in an enclosed position around the connector. The shield housing also includes a downwardly angled rear top wall portion for providing access to release means after the connector has been mounted to a faceplate panel.

5 Claims, 6 Drawing Sheets

SHIELD FOR MODULAR ELECTRICAL CONNECTOR

TECHNICAL FIELD

The present invention relates to shield assemblies for modular electrical connectors, and more particularly to a simple shield assembly for substantially enclosing a modular electrical connector which is easier to assemble in the field.

BACKGROUND OF THE INVENTION

A variety of shield assemblies for at least partially surrounding electrical connectors are known for use with telecommunications equipment in order to reduce RFI (radio frequency interference) and EMI (electromagnetic interference). Prior shield assemblies have included metal housings that only partially enclose the connector as well as multi-part metal housings which were complicated to manufacture as well as assemble in the field. As the number of parts increases, it becomes more difficult to assemble in the field and is more likely that separations between the parts will occur and degrade the performance. Certain prior shield assemblies specifically designed for printed circuit board (PCB) connectors have comprised one-piece foldable metal housings which substantially enclose the PCB connector. However, when a shield assembly is to be used on a modular connector to which an electrical cable is terminated at a rear end, it is necessary to allow access for the cable to the rear end of the connector and to include an integral grounding clip which can be crimped to a foil shield layer provided on the electrical cable to provide continuous common grounding. The cost of manufacturing the stamped and formed metal shield housing and ease of assembly in the field are significant factors when making a shield housing including an integrally formed grounding clip that substantially fully encloses a modular connector and will prevent the various walls of the shield housing from separating and degrading the shielding effect. Therefore, improvement in the field of providing shield assemblies for modular connectors that substantially enclose the connector and include a grounding clip is required.

In general, an improved shield assembly for a modular connector includes a one-piece metal housing having a front wall, a base, and a pair of opposing sidewalls, each one of said sidewalls being situated along a lateral edge of the base between the front wall and an opened rear end of the shield assembly, a top wall hingedly connected to the front wall and movable from an open position to an enclosed position, including an integral grounding clip extending from a rearward distal end of the top wall, and a rear wall section extending from a rear end of at least one opposing sidewall and foldable into a closed position behind an inserted connector. The integrity of the shield enclosure can be enhanced by including a cable support bar disposed perpendicularly away from the rear wall section so that upon folding of the rear wall section into the closed position the support bar is positioned adjacent a terminated cable.

SUMMARY OF THE INVENTION

It is, therefore, an object of the present invention to provide an improved shield assembly for a modular electrical connector.

It is further an object of the present invention to provide a shield assembly which is simple to securely assemble in the field.

It is also an object of the present invention to provide an improved shield housing design for a modular connector intended to be mounted to a faceplate, by way of a latching arm that engages a top side of the connector, that will allow access for removal.

DESCRIPTION OF THE PREFERRED EMBODIMENT

Figure 1:
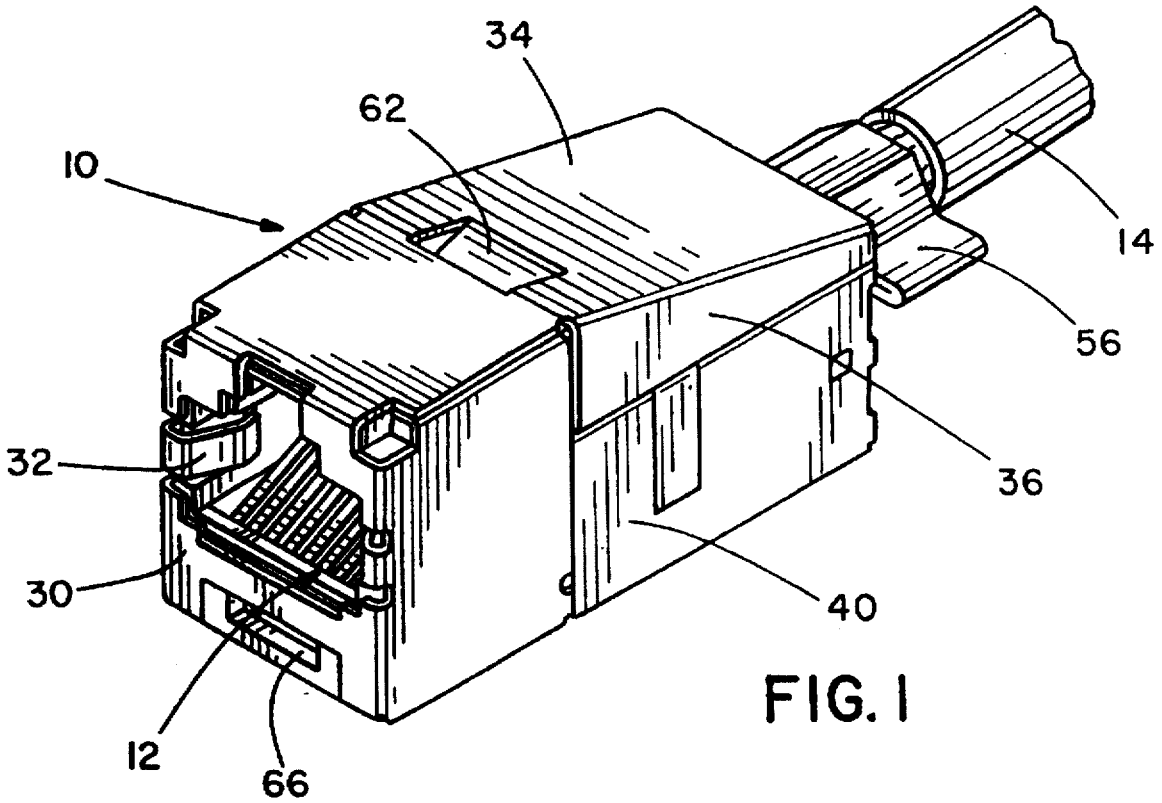
FIG. 1 is a front perspective view of a terminated shielded modular connector of the present invention.
Figure 2:
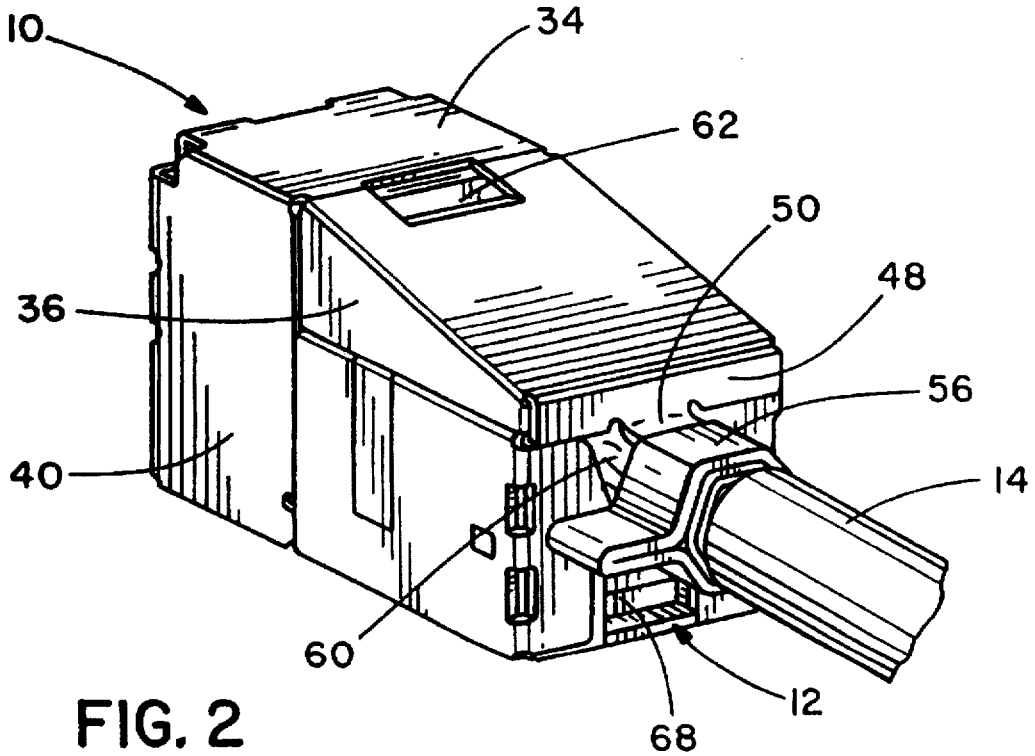
FIG. 2 is a rear perspective view of the terminated shielded modular connector of FIG. 1.
Figure 3:
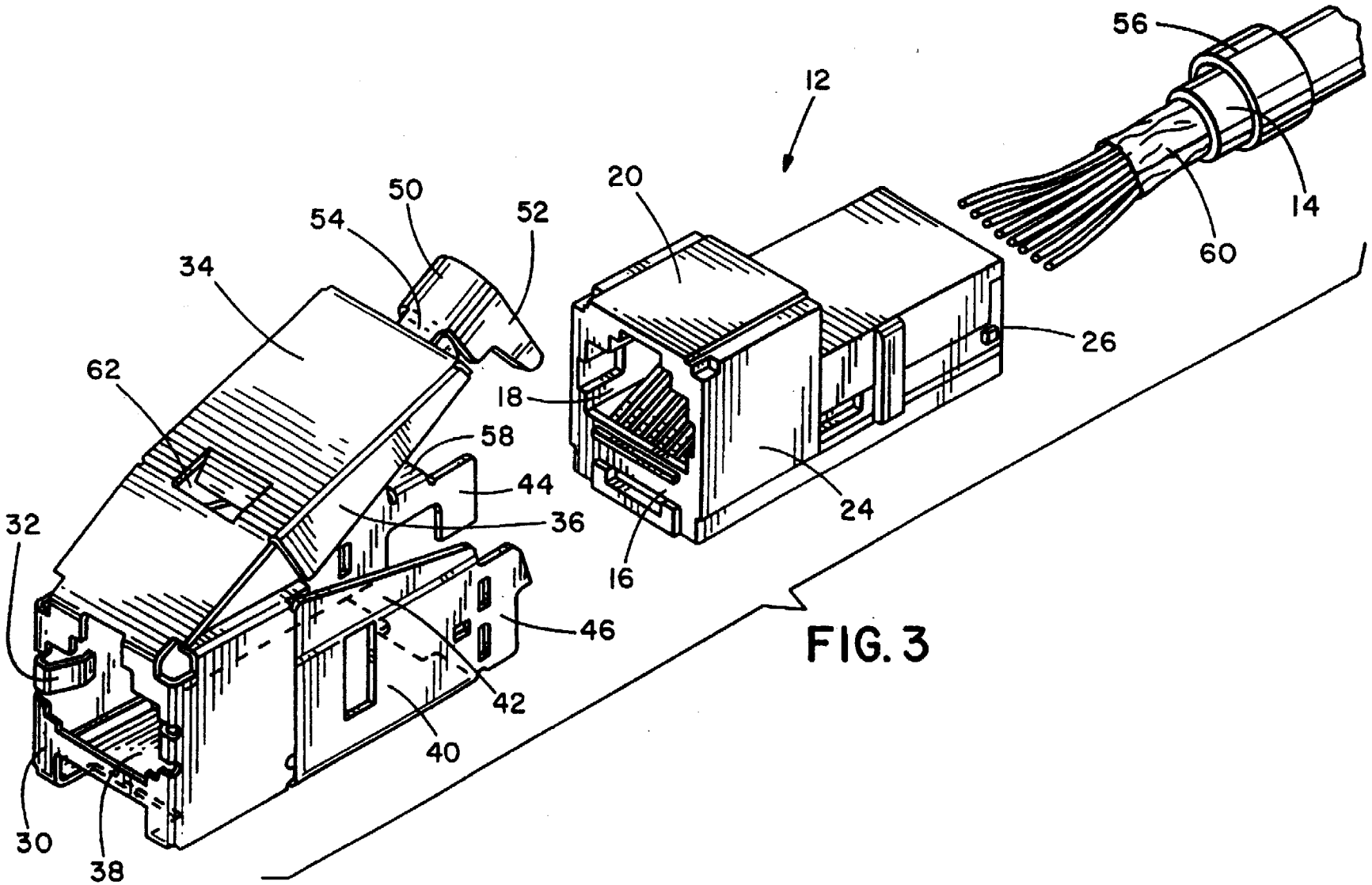
FIG. 3 is an exploded view of the shielded modular connector of FIG. 1.
Figure 5:
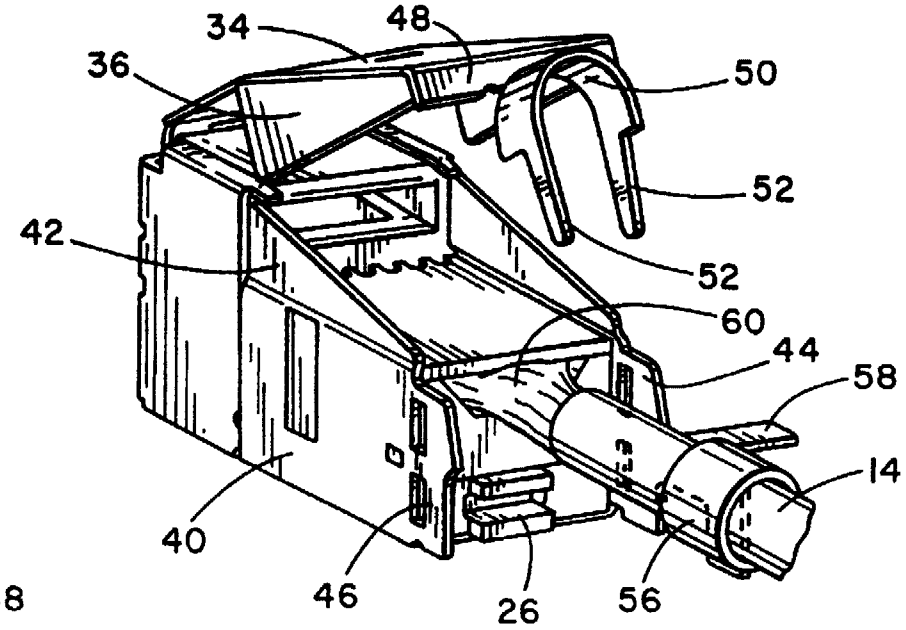
FIG. 5 is a rear perspective view of a modular connector partially assembled to the shield housing.
Figure 4:
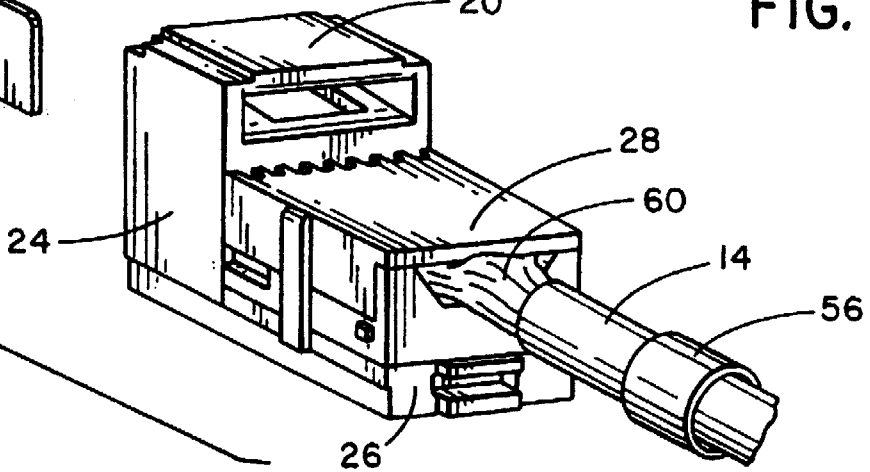
FIG. 4 is a partially assembled view of the shielded modular connector of FIG. 1.
Figure 4:
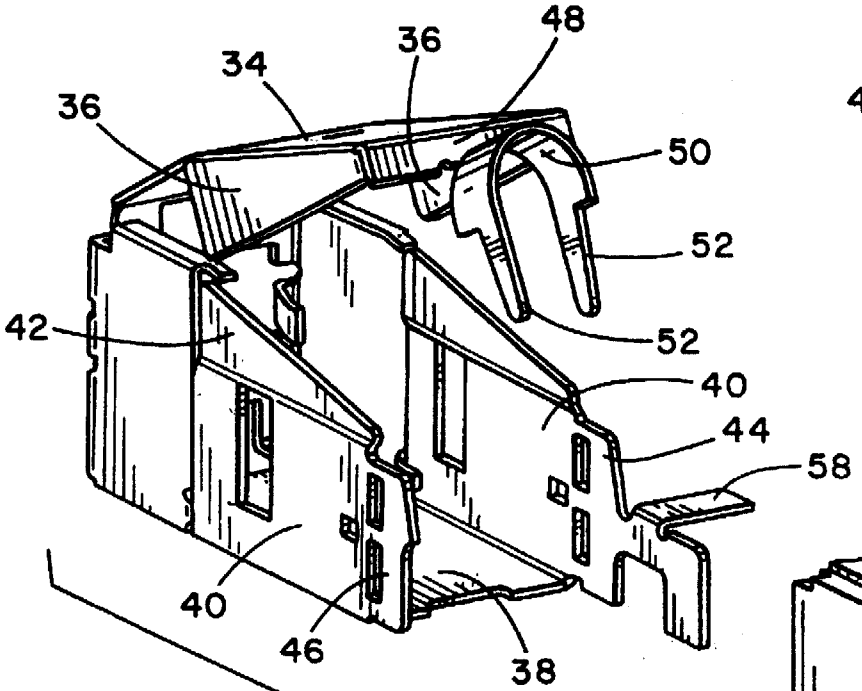
Figure 8:
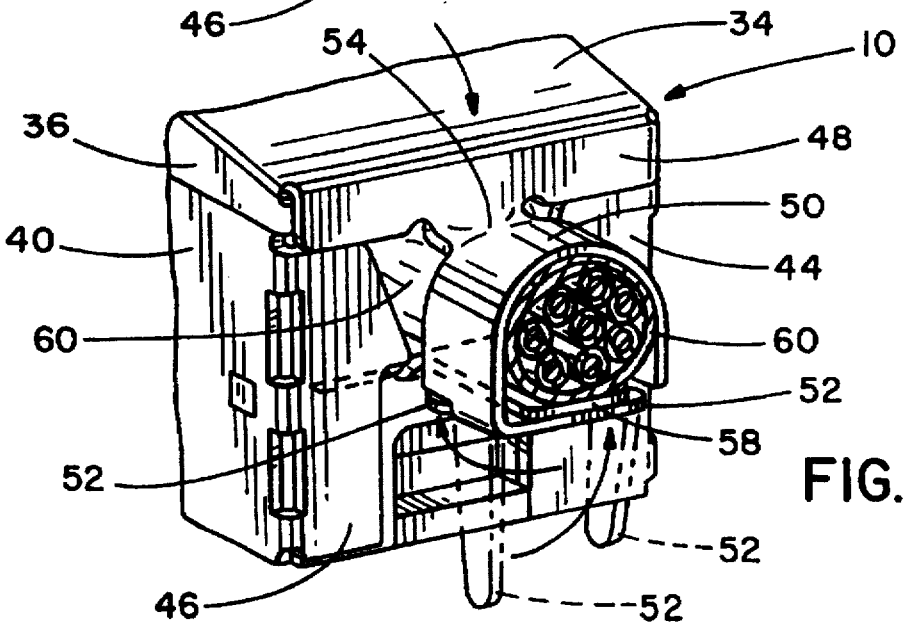
FIG. 8 is a partial rear view of a terminated modular connector being assembled to the shield housing.
Figure 9:
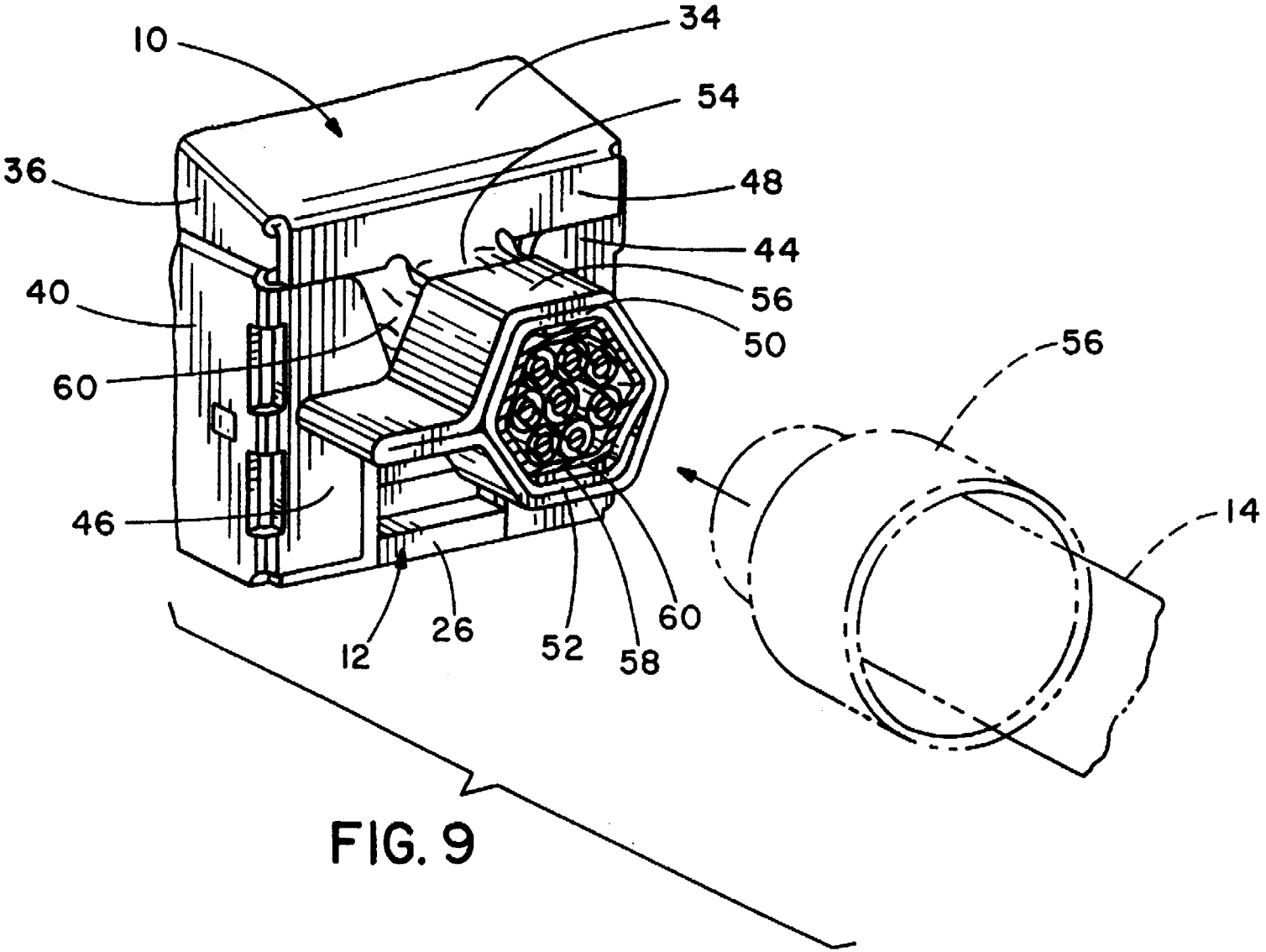
FIG. 9 is a partial rear view of a terminated modular connector being assembled to the shield housing.
Figure 10:
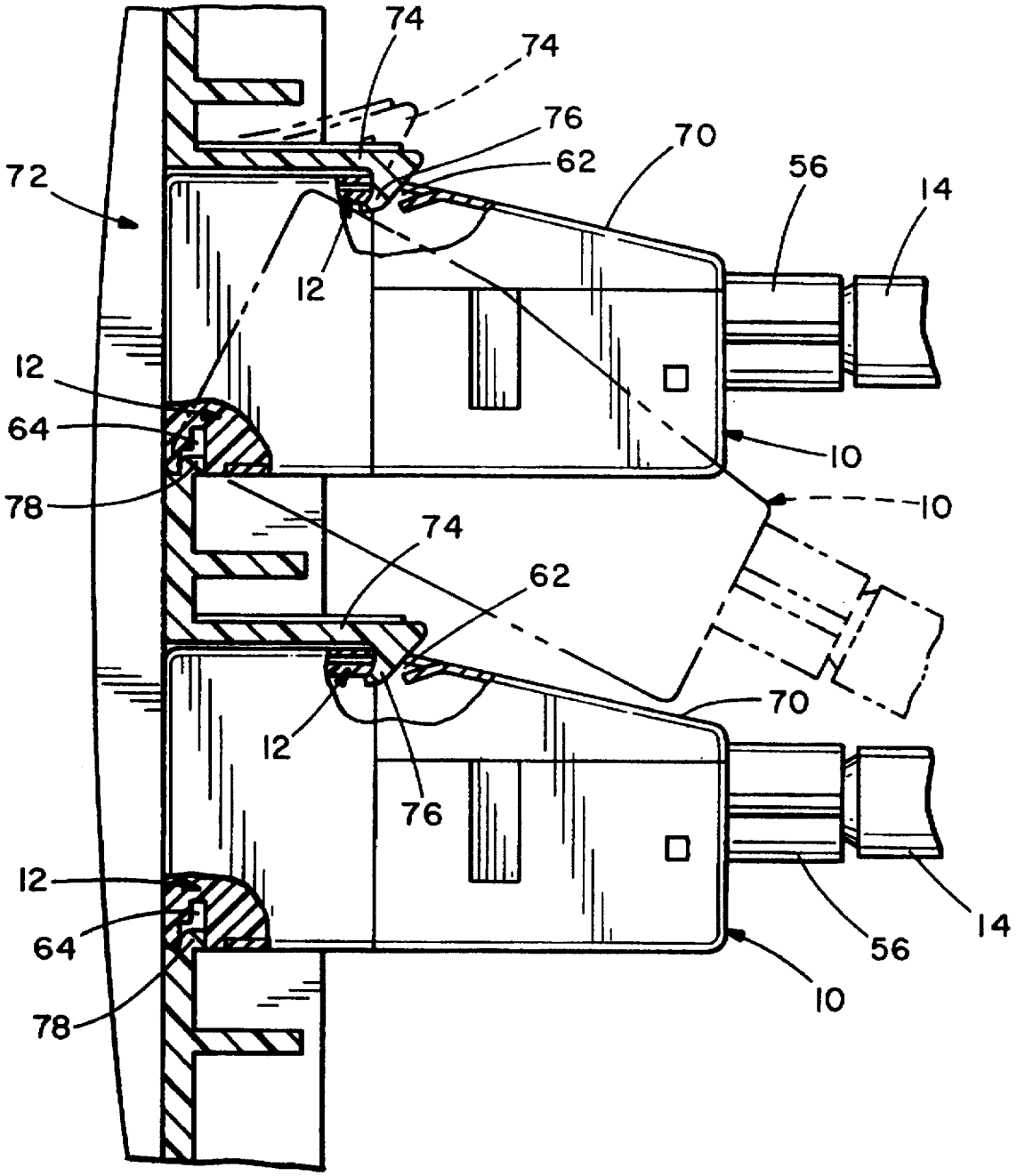
FIG. 10 is a side view of the shielded modular connector latchingly engaged to a faceplate.

A shield assembly embodying the concept of the present invention is designated generally by the reference numeral 10 in the accompanying drawings. As can be seen in FIGS. 1 and 2, shield assembly 10 is a one-piece stamped and formed housing that substantially surrounds a modular electrical connector 12 which has terminated an electrical cable 14 to provide RFI and EMI shielding. As best seen in FIGS. 3 and 4, shield housing 10 is integrally formed to have a front wall 30 with an opening configured to surround a plug receiving opening 18 of an electrical connector 12, a base wall 38 and a pair of opposing sidewalls 40 positioned on the lateral edges of base 38 between the front wall 30 and the opened rear end of the shield assembly 10. The front wall 30 of the shield housing includes a pair of wiping tabs 32 which extend to the plug receiving opening 18 of the connector in order to create a continuous ground with the mated plug (not shown). Shield housing 10 further includes a hingedly connected top wall 34 that includes a grounding clip 50 having a pair of crimp tabs 52 at the end of a clip arm 54 extending from the rearward distal end of top wall 34 for engagement with a foil shield sheath 60 of the electrical cable 14 that has been terminated to the modular connector 12. As can be seen in FIGS. 4 and 5, each sidewall 40 includes an inset wall portion 42 at a top end thereof and top wall 34 includes a pair of complimentary flange portions 36. The top wall 34 is movable from an open position to an enclosed position in which grounding clip 50 is bent down adjacent cable 14. The crimping of grounding clip 50 to the foil shield sheath 60 provides continuous common grounding. As can be seen in FIG. 8, the rear end of the top wall also includes a rear flange 48 extending a sufficient length to partially cover the folded rear wall section 46. Shield housing 10 also includes front and rear latch openings 66,68 that correspond to latching areas on the modular connector 12 for latching the connector to a communication box (not shown) or other assembly. Similarly, shield housing 10 includes top and bottom latch openings 62,64 which provides access to the means on connector 12 for mounting to a panel or faceplate as shown in FIG. 10.

As best seen in FIG. 3, a standard modular electrical connector has a front end 16 that includes a plug receiving opening 18, a top 20, a pair of opposing sides 24, and a rear end 26 at which an electrical cable 14 is terminated. The modular connector utilized with the present invention terminates the cable 14 by a termination cap 28.

As best seen in FIG. 4, shield assembly 10 is preformed into a box-like housing assembly that has a rear opening which in conjunction with the hingedly connected top wall 34 allows for the insertion of modular connector 12 such that the plug receiving opening 18 of connector 12 will correspond to an opening in the front shield wall 30.

The method of securing the shield housing 10 to a modular connector 12 is best shown in FIGS. 5–9. FIG. 5 shows the connector 12 inserted into the open rear end of shield housing 10 until the front end 16 of connector 12 abuts front wall 30 of shield 10. After the modular connector 12 has been inserted within the shield housing 10, the rear wall sections 44,46 are folded over the rear end 26 of the modular connector 12. Rear wall section 44 includes a cable support bar 58 which is disposed perpendicularly away from rear wall section 44 and situated such that the folding over of rear wall section 44 behind the inserted connector 12 positions support bar 58 adjacently underneath the terminated cable 14. The grounding clip 50 is then folded down adjacent the foil shield sheath 60 of the electrical cable 14 and crimped around the cable and the cable support bar 58. Finally, a crimp ring 56 is inserted around the grounding clip 50 and crimp tabs 52 and crimped thereto. The engagement of the grounding clip 50 to the electrical cable 14 closes the top wall 34 and secures the top wall 34 in an enclosed position around the connector 12. Thus it is seen that in the field the installer merely needs to insert the connector 12 fold over the rear walls to secure the connector within and bring down the grounding clip 50 and crimp it to the cable 14 to securely enclose shield housing 10 around connector 12. The support bar 58 enhances the integrity of the enclosed shield housing 10 by adding protection from the top wall 34 pulling away from the connector 12.

As can be seen in FIG. 10, shield housing 10 also includes an angled top wall portion 70 extending from the front of the top latch opening 62 downward towards the rear end such that when shielded electrical connectors 12 are mounted to panels such as faceplates 72 in which multiple connectors are mounted on top of each other, the angled surface 70 allows for easier insertion and removal of adjacent shielded connectors 12, as well as providing access to the latch portion 76 of latch member 74 by a screwdriver or other prying device (not shown).

While the particular preferred embodiment of the present invention has been shown and described, it will be obvious to those skilled in the art that changes and modifications may be made without departing from the teachings of the invention. The matter set forth in the foregoing description and the accompanying drawings is offered by way of illustration only and not as a limitation. The actual scope of the invention is intended to be defined in the following claims when viewed in their proper perspective based on the prior art.

What is claimed is:

1. A shield assembly for receiving and surrounding an electrical connector, comprising:

a one-piece metal housing having a from wall, a base, and a pair of opposing sidewalls, each one of said sidewalls being situated along a lateral edge of the base between the front wall and an opened rear end of the shield assembly;

a top wall hingedly connected to the front wall and movable from an open position to an enclosed position, including an integral grounding clip extending from a rearward distal end of the top wall; and rear wall sections extending from rear wall ends of the opposing sidewalls and foldable into a closed position behind the electrical connector, wherein the top wall includes a latch opening for allowing a latch member extending from a panel and engaging directly to the electrical connector through the latch opening to secure the electrical connector to the panel, wherein the top wall further includes a sloped portion angled downwardly from the latch opening towards the rear end that provides access to the latch from the rear end.

2. A shield assembly according to claim 1, wherein the rear wall section includes a cable support bar disposed away from the rear wall section so that upon folding of the rear wall section into the closed position the support bar is positioned adjacent a terminated cable.

3. A shield assembly according to claim 1, wherein each sidewall includes an inset wall portion at a top end thereof, and the top wall includes a pair of complementary flange portions which matingly nest with the inset wall portions when the top wall is moved into the enclosed position.

4. A shield assembly according to claim 1, wherein the top wall includes a rear flange extending a sufficient length to partially cover the folded rear wall section.

5. A shield assembly for receiving and surrounding an electrical connector that is mounted to a panel by a latching arm engaging with the connector, said shield assembly comprising:

a metal shield housing formed by a front wall, a base, a pair of opposing sidewalls and including an integral grounding clip extending from the shield housing;

wherein the shield housing further includes a top wall hingedly connected to the front wall and movable from an open position to an enclosed position, said top wall having an opening and a sloped portion downwardly angled and extending from the shield opening towards a rear end of the connector, wherein the sloped portion provides access to the latching arm by a prying device.

* * * * *

UNITED STATES PATENT AND TRADEMARK OFFICE

CERTIFICATE OF CORRECTION

PATENT NO. : 5,733,146
DATED : March 31, 1998
INVENTOR(S) : Dale A. Block

Figure 6:
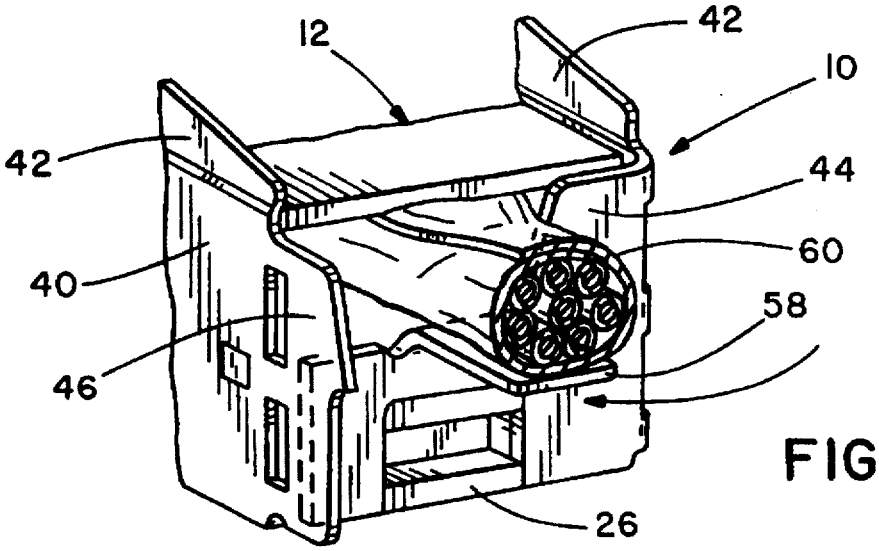
FIG. 6 is a partial rear view of a terminated modular connector being assembled to the shield housing.
Figure 7:
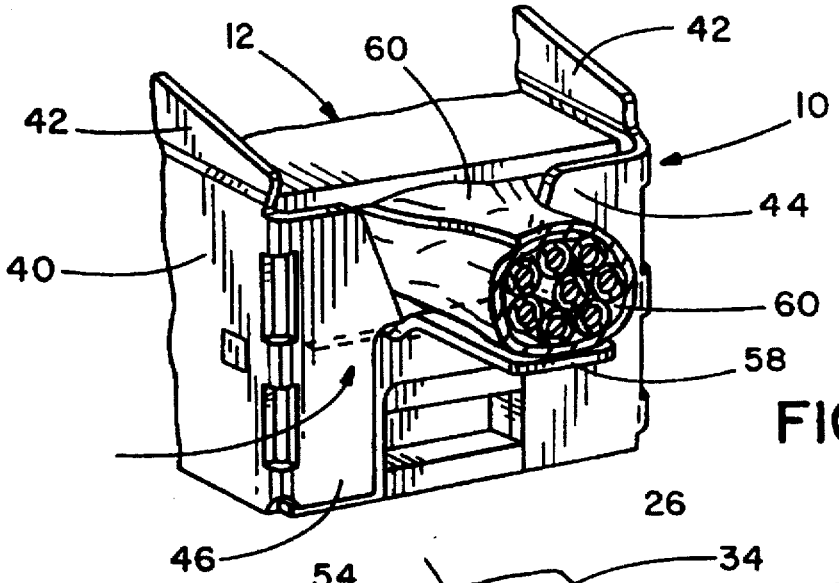
FIG. 7 is a partial rear view of a terminated modular connector being assembled to the shield housing.

It is certified that error appears in the above-identified patent and that said Letters Patent is hereby corrected as shown below:

Column 2, line 58, after "Cable 14" insert --The complimentary flange portions 36 matingly nest with the inset wall portions 42 as shown in FIGS. 6-8 when top wall 34 is moved into the enclosed position.--.

Column 4, line 9, change "from" to --front--.

Signed and Sealed this

Third Day of August, 1999

*Attest:*

Q. TODD DICKINSON

*Attesting Officer*

*Acting Commissioner of Patents and Trademarks*